US011116056B1

(12) United States Patent
Marting

(10) Patent No.: US 11,116,056 B1
(45) Date of Patent: Sep. 7, 2021

(54) LED LIGHTING PANEL WITH TRANSLUCENT INSULATING DIFFUSER

(71) Applicant: Caleb Marting, Iowa City, IA (US)

(72) Inventor: Caleb Marting, Iowa City, IA (US)

( * ) Notice: Subject to any disclaimer, the term of this patent is extended or adjusted under 35 U.S.C. 154(b) by 34 days.

(21) Appl. No.: 16/682,069

(22) Filed: Nov. 13, 2019

Related U.S. Application Data

(60) Provisional application No. 62/769,325, filed on Nov. 19, 2018.

(51) Int. Cl.

| | |
|---|---|
| ***H05B 45/24*** | (2020.01) |
| ***F21V 33/00*** | (2006.01) |
| ***F21V 23/00*** | (2015.01) |
| ***G10K 11/162*** | (2006.01) |
| ***F21V 21/08*** | (2006.01) |
| ***H05B 47/18*** | (2020.01) |
| ***H05B 47/19*** | (2020.01) |
| ***F21W 121/00*** | (2006.01) |
| ***F21Y 115/10*** | (2016.01) |
| ***F21Y 105/16*** | (2016.01) |
| ***F21Y 113/13*** | (2016.01) |

(52) U.S. Cl.
CPC ..... *H05B 45/24* (2020.01); *F21V 21/0808* (2013.01); *F21V 23/003* (2013.01); *F21V 33/0056* (2013.01); *G10K 11/162* (2013.01); *H05B 47/18* (2020.01); *H05B 47/19* (2020.01); *F21W 2121/00* (2013.01); *F21Y 2105/16* (2016.08); *F21Y 2113/13* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2003/0223249 | A1* | 12/2003 | Lee | G02F 1/133608 362/561 |
| 2016/0186942 | A1* | 6/2016 | Gier | F21S 8/026 362/234 |
| 2019/0295458 | A1* | 9/2019 | Krass | G02B 6/10 |

* cited by examiner

*Primary Examiner* — Crystal L Hammond
(74) *Attorney, Agent, or Firm* — Shuttleworth & Ingersoll, PLC; Jason R. Sytsma

(57) ABSTRACT

A translucent insulating material providing a decorative wall covering; at least one lighting element combined on an underside of the translucent insulating material; and a controller combined to the at least one lighting element for synchronizing an output of the at least one lighting element to at least one characteristic of a media input.

19 Claims, 6 Drawing Sheets

LED LIGHTING PANEL WITH TRANSLUCENT INSULATING DIFFUSER

The present application claims the benefit of U.S. Provisional Application No. 62/769,325 filed Nov. 19, 2018, the contents of which are incorporated herein by reference.

TECHNICAL FIELD

The present disclosure relates to a decorative luminous panel assembly, and more specifically, this disclosure is directed to a translucent luminous panel backlit by light emitting diodes that light in patterns in synchronization with a defined input.

BACKGROUND INFORMATION

It has long been known that sound-absorbing material can be employed to change the acoustic qualities of a space. Sound-absorbing or acoustic material may be applied to all or part of the walls and/or ceilings. Such material may also be applied to fixtures or furniture to dampen the sound. Such spaces where acoustic material would be advantageous may be studios, dance halls, concert venues and auditoriums, ballrooms, clubs, theaters, sets, gyms, and homes. Many of the spaces in which acoustic material would be advantageous are also spaces where light displays may be desired.

Light displays may be accomplished by various types of lighting such as glass bulbs. Bulbs, however, do not have a long life, are energy inefficient, and replacing them can be time consuming and expensive. Another lighting option is fiber optics powered by halogen light sources. However, fiber optic lighting systems are expensive to install and require a lot of energy to light. Light emitting diodes (LED's) may be considered for lighting displays due to their long life and lower energy usage.

Light displays in and around acoustic material would typically require either placing the lights over acoustic material or routing the lights around and between the acoustic material. Placing lights over acoustic material may not be an attractive option. Frequently acoustic material has bumps and/or ridges to aid in the sound-dampening properties of the material. As such, LED lights may not look attractive over the bumps and ridges, and the acoustic material could be damaged while applying lighting elements. Moreover, such light displays may have exposed lights and circuitry, which may be aesthetically displeasing.

Accordingly, there is a need for a panel of translucent sound-insulating material with lighting elements which may be combined with other panels and which may be operated by a controller to correspond to an input data such as audio data.

SUMMARY

Disclosed is an acoustic panel comprising a translucent insulating material providing a decorative wall covering; at least one lighting element combined on an underside of the translucent insulating material; and a controller combined to the at least one lighting element for synchronizing an output of the at least one lighting element to at least one characteristic of a media input.

In one implementation, a plurality of lighting elements arranged in a matrix and attached on an underside of the translucent insulating material. A plurality of acoustic panels can be connected in either serial connection or parallel and are arranged on a wall to form a largescale synchronized visual display. The translucent insulating material and the matrix are bound to a backing by an adhesive. The controller can be in communication with a network by either a direct network connection or a wireless network connection. A data-in cable and a data-out cable can penetrate a backing of the lighting elements and connect to a second acoustic panel, the controller, or a voltage source.

In operation, the output of the at least one lighting element includes a display of light patterns and colors. The display is synchronized to the at least one characteristic of the media input. The media input can come from an audio input, a tune, a song, a visual display, a movie, or a video game. The media input is processed by the controller to generate a light pattern for the output of the at least one lighting element. A recording device in communication with the controller can be provided to record the media input for processing by the controller with the display synchronized by the controller to correspond to at least one characteristic of the media input.

In another implementation, a method of creating a visual acoustic display is provided. The method includes providing an acoustic panel as a decorative wall covering. The acoustic panels comprise a translucent insulating material; at least one lighting element combined on an underside of the translucent insulating material; and a controller combined to the at least one lighting element. The method continues with synchronizing an output of the at least one lighting element to at least one characteristic of a media input. And, controlling the output of the at least one lighting element using the at least one characteristic of the media input.

BRIEF DESCRIPTION OF THE DRAWINGS

These and other features and advantages of the present invention will be better understood by reading the following detailed description, taken together with the drawings wherein.

DETAILED DESCRIPTION

Figure 5:
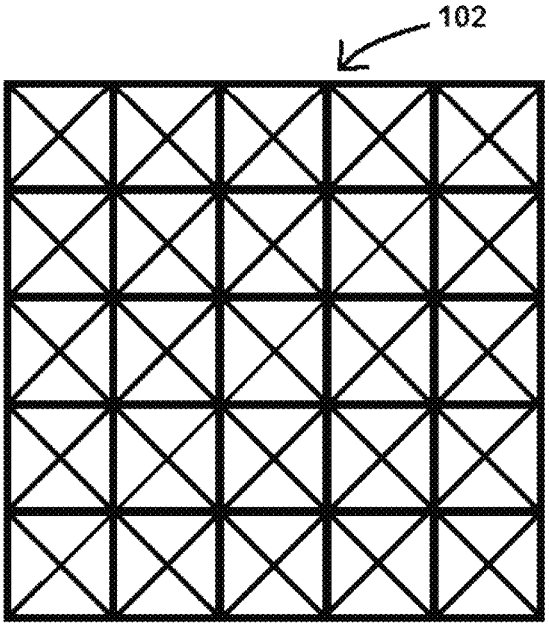
FIG. 5 is a pyramid patterned translucent insulating material for the acoustic panel.
Figure 6:
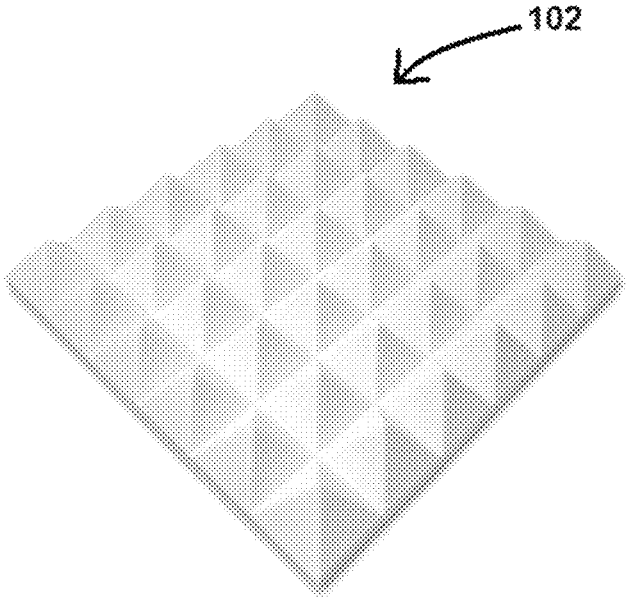
FIG. 6 is a perspective view of translucent insulating material for the acoustic panel.
Figure 7:
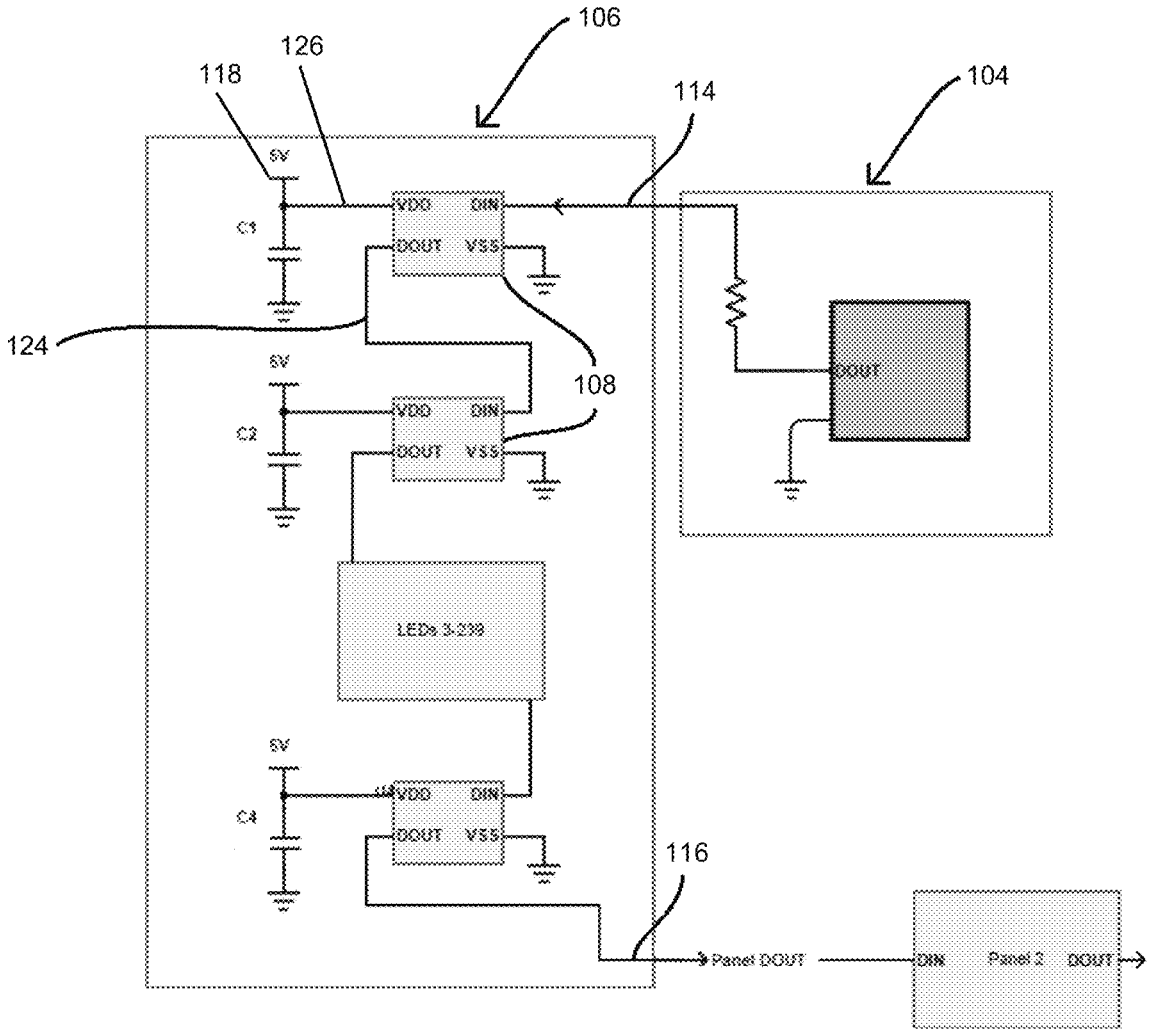
FIG. 7 is a schematic diagram of the acoustic panel attached to a controller and attached to a second acoustic panel.

Referring to FIGS. 1-7, disclosed is an acoustic panel 100 with a translucent insulating material 102, a plurality of lighting elements 108 combined to the underside of translucent insulating material 102, and a controller 104 to synchronize the output of the lighting elements 108. Acoustic panel 100 conveys a media such as audio in a visual output, while passively enhancing the quality of the sound. Acoustic panel 100 is combined with the controller 104 and a power source 122, as shown in FIG. 7. Controller 104 manages acoustic panel 100, controlling the lighting patterns and colors of lighting elements 108. Controller 104 may receive input data over a direct or wireless connection for controlling lighting elements 108. It may also provide its own programmed autonomous background patterns.

Figure 1:
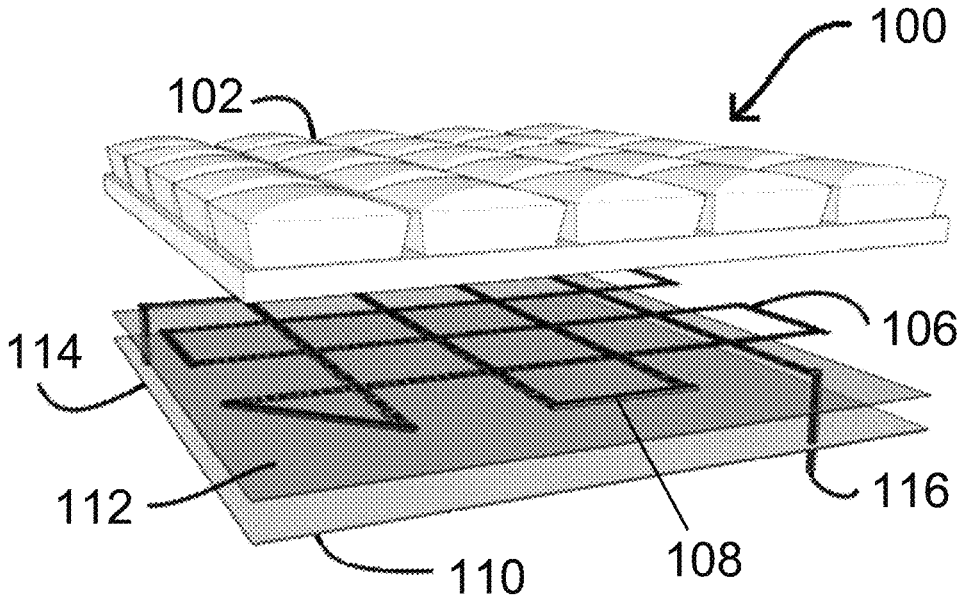
FIG. 1 is a perspective view of the acoustic panels according to this disclosure.

More specifically, FIG. 1 shows acoustic panel 100 with a layer of translucent insulating material 102 and a matrix 106 of lighting elements 108. Translucent insulating material 102 allows light to be visible through the material, but prevents the defined shape of the plurality of lighting elements 108 from being visible through the material. The translucent insulating material 102 also includes semi-translucent material. Semi-translucent material allows some light through the material, but not as much light as translucent material. Both translucent and semi-translucent prevent details from being viewed through the material. Reference to translucent material is intended to also include semi-translucent material. The translucent insulating material 102 may be acoustic foam, vinyl, plastic, or textiles.

The translucent insulating material 102 and the matrix 106 are bound to a backing 110 with a layer of adhesive 112. The backing 110 encloses the acoustic panel 100 from the back. The backing 110 provides one continuous surface at the back of the acoustic panel 100 to attach the acoustic panel 100 to a wall, ceiling, or other surface. The backing 110 may be a plastic sheet backing, foam backing, wood, or any other material which could attach to the back of the acoustic panel to provide a continuous surface. The adhesive 112 may be, but is not limited to, a glue, spray adhesive, heated adhesive, epoxy, polyurethane, or contact adhesive.

Figure 4:
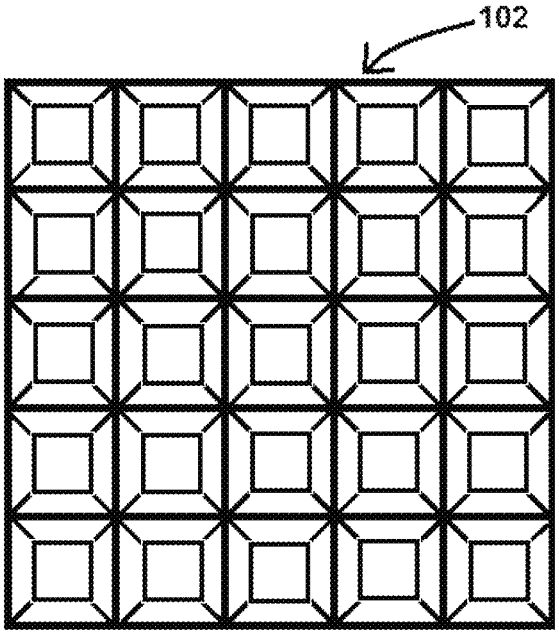
FIG. 4 is translucent insulating material for the acoustic panel.

FIGS. 4-5 show a top view of a layer of translucent insulating material 102. Light from lighting elements 108 filters through layer of translucent insulating material 102 resulting in a soft, even, diffused light. The translucent insulating material 102 may be moderately translucent or completely translucent. The translucent insulating material 102 is not completely transparent because it may be aesthetically displeasing to see the wiring detail behind the material, and because the light would not be a soft, evenly distributed light. In addition, the translucent insulating material 102 is not completely opaque because light must be able to filter through the material.

The translucent insulating material 102 may have planar shapes and patterns, and three dimensional shapes and patterns. The translucent insulating material 102 may be provided in many geometric shapes and sizes. FIGS. 4-5 show two examples of a three dimensional geometric shapes of the translucent insulating material 102. FIG. 4 shows a shape with a flat top to provide a substantially planar surface. FIG. 5 shows a pyramid shape. FIG. 6 shows the pyramid shape from a perspective view. In one embodiment the translucent insulating material 102 is the same shape and size as the backing 110 and has a pattern which corresponds to the matrix 106. The translucent insulating material 102 may also be provided as two or more pieces of material which completely cover the top of the acoustic panel 100.

A data-in cable 114 and a data-out cable 116 penetrate both the adhesive 112 and the backing 110. In one embodiment, the data-in cable 114 may be connected to the controller 104 and the data-out cable 116 may be connected to a power source 122, as shown in FIG. 7. In another embodiment, the data-in cable 114 may be connected to the controller 104 and the data-out cable 116 may be connected to the data-in cable 114 of a second acoustic panel 100, wherein each acoustic panel may be connected to its own power source. A number of acoustic panels 100 may be connected in this way using serial protocol. Serial protocol is the connecting the data-out cable 116 of one acoustic panel 100 to the data-in cable 114 of another acoustic panel 100 to allow many acoustic panels 100 to be daisy-chained together so that the matrix 106 may be controlled by one controller 104.

The controller 104 may synchronize an output of the lighting elements 108 to an audio or visual input data by synchronizing the output to a characteristic or a combination of characteristics of the audio or visual input data, such as pitch, key, tone, volume, metre and rhythm.

Figure 2:
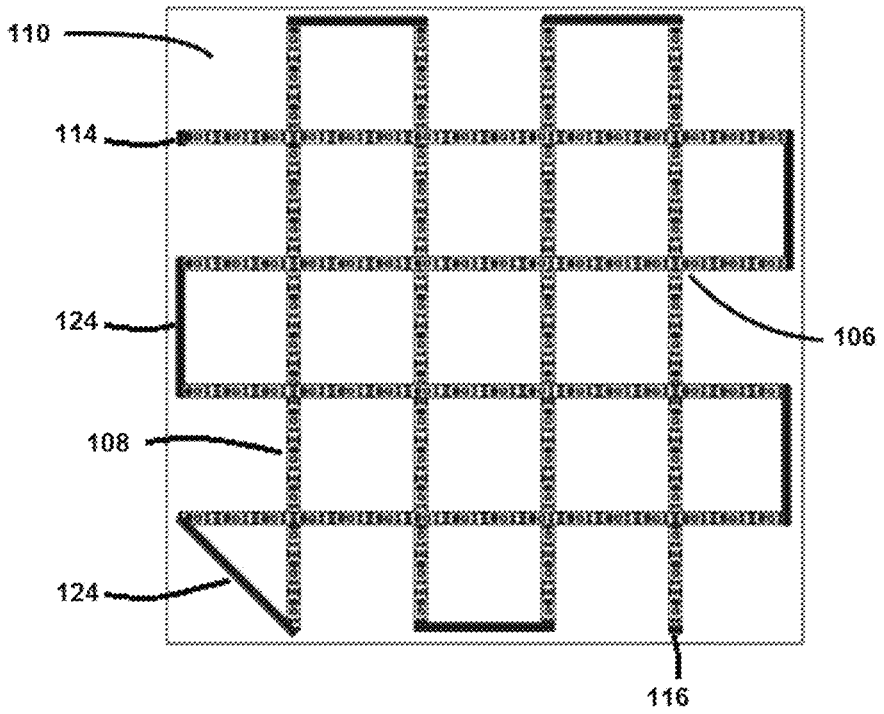
FIG. 2 is a plan view of a matrix of light elements and sheeting of FIG. 1
Figure 3:
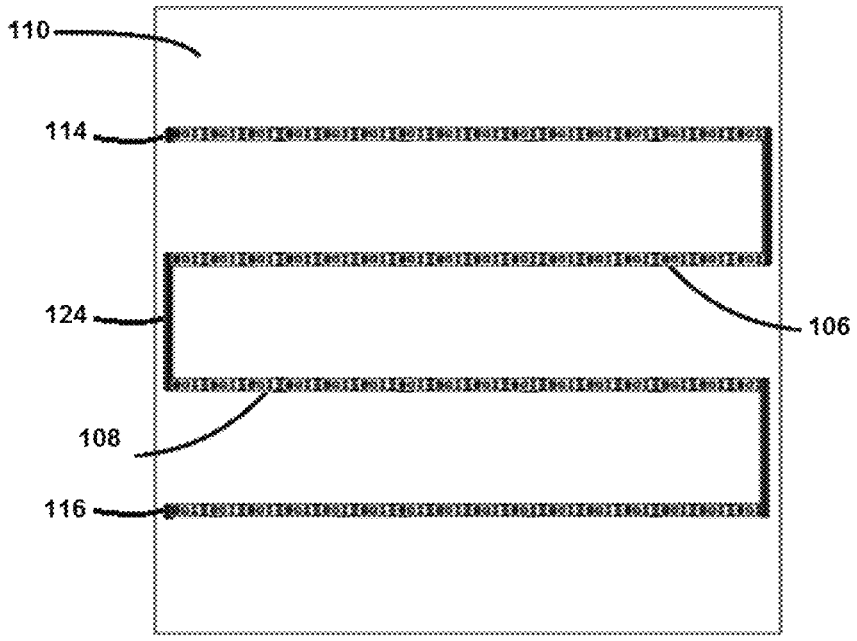
FIG. 3 is a plan view of an S-shaped matrix of light elements and sheeting.

FIGS. 2 and 3 show a detailed drawing of the matrix 106 of lighting elements 108. FIG. 2 shows a crisscross matrix 106 while FIG. 3 shows an s-shaped matrix 106. The matrix 106 comprises lighting elements 108 in series. Lighting elements 108 may be solid state lights, such as those using semi-conductor light-emitting diodes (LED), organic light-emitting diodes (OLED), polymer light-emitting diodes (PLED), solid state lasers, or any other lighting element. Lighting elements 108 may include individual solid state lights or strips that contain a plethora of addressable lighting elements 108. The lighting elements 108 may be LED modules containing different colors with differing intensity levels and connected using the serial protocol described above. The matrix 106 is connected to the data-in cable 114 and the data-out cable 116.

FIG. 7 shows a detailed wiring diagram of the matrix 106 comprised of lighting elements 108. The lighting elements 108 are connected to each other in series with wiring 124. The lighting elements 108 within the matrix 106 are also each connected to a lighting element voltage source 118 with wiring 126. The respective ends of the matrix 106 are connected to the data-in cable 114 and the data-out cable 116.

Figure 8:
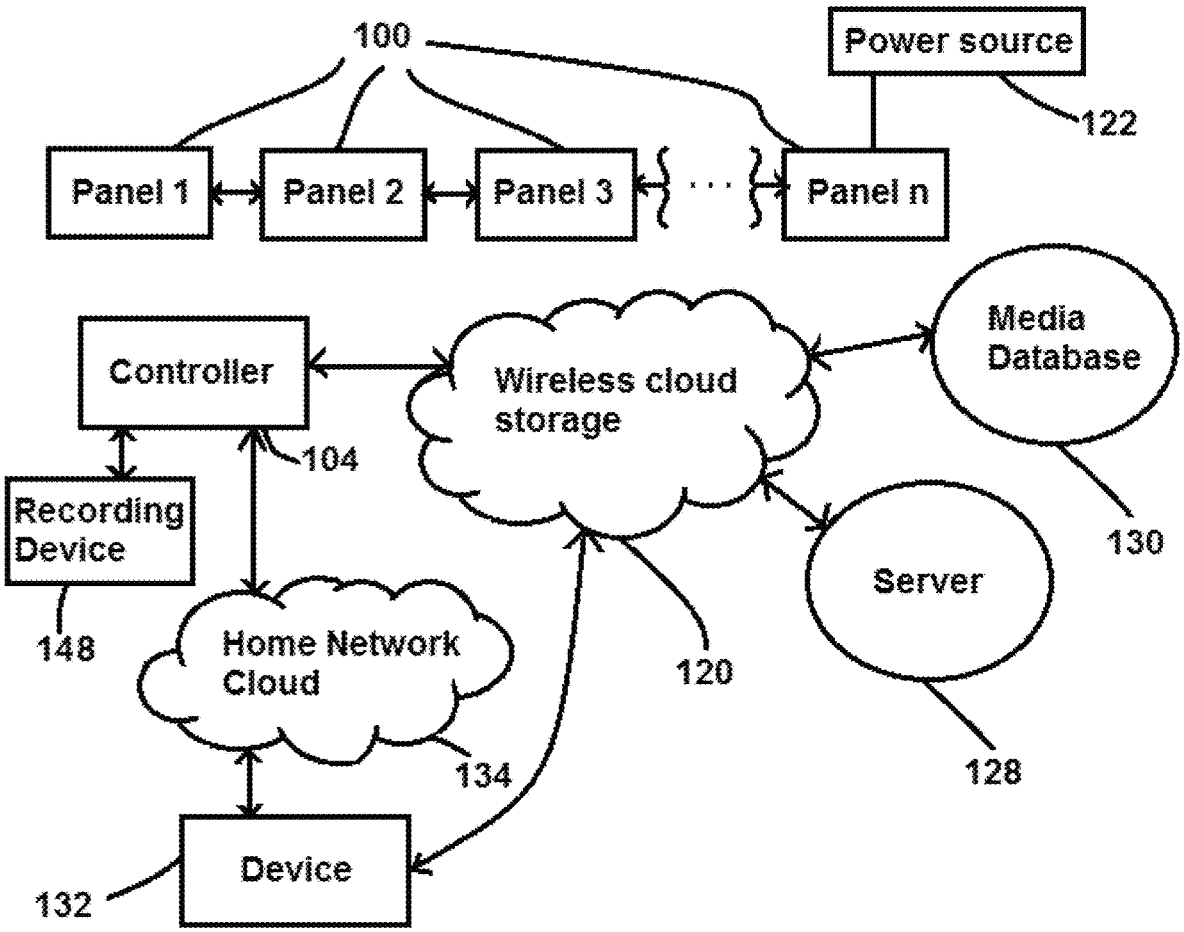
FIG. 8 is a schematic diagram of an n-number of acoustic panels attached to a controller connected to a wireless cloud-based storage, which is connected to a server or other media database.

FIG. 8 shows a schematic diagram of an n-number of acoustic panels 100 connected to controller 104, wherein the controller 104 is in connection with an internet cloud 120 to provide temporary storage for the data and programming instructions, wherein a wireless cloud-based storage, such as a server 128 or a media database 130 may be used to provide permanent storage for the data and programming instructions. The internet cloud 120 may be Amazon Cloud, Microsoft Azure, or the user's own cloud media storage. The server 128 or media data base 130 may provide audio or visual input used to synchronize the output display of the acoustic panel 100. The audio or visual input data may be an audio input, a tune, a song, a visual display, a movie, video game and/or other media.

The controller 104 may also be connected to a device 132 and receive input data from the device 132, such as a phone, a virtual assistant, a home monitoring system, a remote control, and a speaker. The device 132 may have its own storage or be connected to a local home wireless network cloud 134. The device 132 may connect to the controller 104 using the home network cloud 134.

Figure 9:
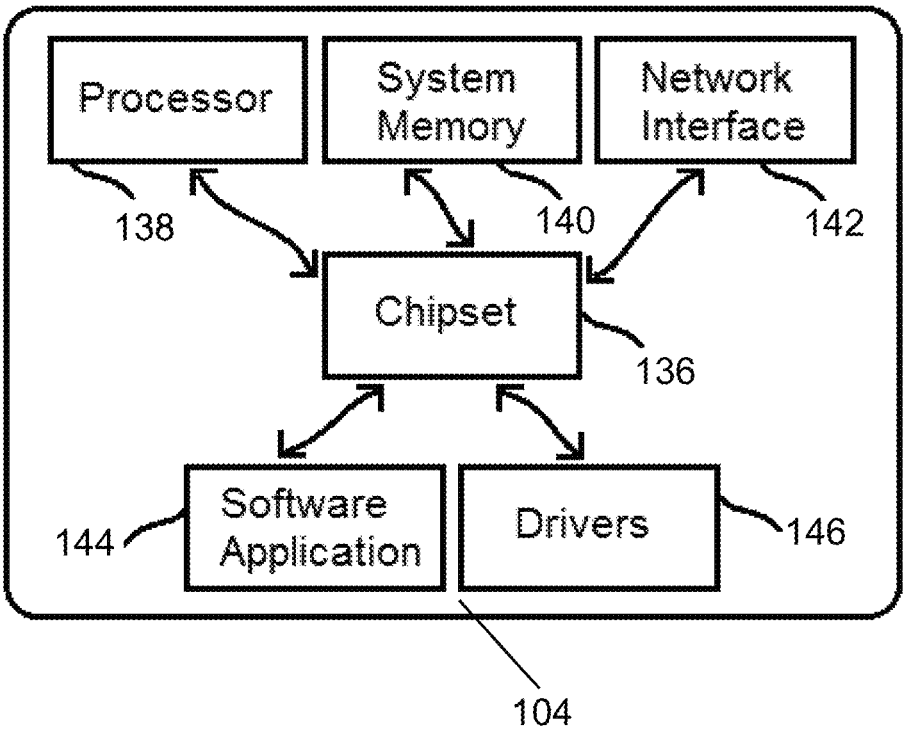
FIG. 9 is a controller which includes a chipset with a processor, system memory, a network interface, a driver, and a software application.

FIG. 9 shows a schematic diagram of the controller 104, wherein such controller 104 includes a chipset 136 in communication with a processor 138, a system memory 140, network interface 142, one or more software applications 144, and a driver 146 enabling or implementing the methods and functions described herein. Elements described above perform their conventional functions known in the art. In particular, a network interface 142 is used to provide communication between processor 138 and Ethernet or other networks, such as internet cloud 120 or local home wireless network cloud 134, (or any other network or external device, including master controller or other processors). Mass storage such as a server 128 or media database 130 can be provided as indicated in FIG. 8 and used to provide permanent storage for the data and programming instructions to perform the above-described functions implementing the test to be carried, whereas system memory 140 (e.g., DRAM) is used to provide temporary storage for the data and programming instructions when executed by the processor 138.

The controller 104 may use a software application 144, such as a Fast Fourier Transform, or other similar algorithm such as a FHT (Fast Hartley Transform), or any other Fourier series decomposition technique to generate a spectrum graph of the incoming signal. This graph can then be further processed by the processor 104 to determine beat onsets, the overall "energy" (average of the signal graph), or more. These measures can then be used in lighting algorithms. For instance, an algorithm could use the "energy" measure to determine hue and brightness of a color and send that to the acoustic panel as a uniform color across all pixels.

The controller 104 may also receive input data as audio data from an onboard recording device 148 such as a microphone or video recorder, through a direct connection or over a wireless connection. This data may be processed by a software application 144 including algorithms to generate lighting patterns. The flexibility of input allows this device to be useful in multiple scenarios, setups, or configurations. In such case, an event host could use an onboard microphone to record the audio level to gauge audience approval. For instance, asking the audience three different times for three different options, and the choice with the loudest audio level (cheering, clapping, etc.) would be chosen. This works in tandem with the ability of the acoustic panel to display visual data, allowing the audience to receive feedback on their volume. The acoustic panel 100 is different from other similar devices because it allows for visual data feedback (unlike regular acoustic foam) and it also passively improves the quality of sound (unlike hard plastic diffusers on other acoustic panels).

The acoustic panel 100 and controller 104 may also display programmed autonomous patterns. For example, after a defined time period of inactivity, it could start displaying a sleep pattern, or simply turn itself off. It could display simple lighting patterns without sound interactivity, or static colors. This is perfect for sets or homes, where sound interactivity could be somewhat distracting.

The controller 104 may communicate with the acoustic panel 100 via a single wire serial protocol. This means that each acoustic panel can be connected to its own power source, and the number of acoustic panels chained together in series can be theoretically infinite. In practice, there is a cap before the refresh rate of the acoustic panels becomes too slow to be feasible. The controller 104 need only share a ground and data connection, and following acoustic panels need only share ground and data as well.

The term "processor" as generally used herein refers to any logic processing unit, such as one or more central processing units (CPUs), digital signal processors (DSPs), application-specific integrated circuits (ASIC), etc. The processing system can include components within a larger computer system. The processor 138 and memory 140 can be monolithically integrated onto a single chip 136, distributed among a number of chips or components, and/or provided by some combination of algorithms. The components of any system that include the systems and methods herein described can be located together or in separate locations. Communication paths couple the components and include any medium for communicating or transferring files among the components. The communication paths include wireless connections, wired connections, and hybrid wireless/wired connections. The communication paths also include couplings or connections to networks including local area networks (LANs), metropolitan area networks (MANs), wide area networks (WANs), proprietary networks, interoffice or backend networks, and the Internet. Furthermore, the communication paths include removable fixed mediums like floppy disks, hard disk drives, and CD-ROM disks, as well as flash RAM, Universal Serial Bus (USB) connections, RS-232 connections, telephone lines, buses, and electronic mail messages.

Aspects of the systems and methods described herein may be implemented as functionality programmed into any of a variety of circuitry, including programmable logic devices (PLDs), such as field programmable gate arrays (FPGAs), programmable array logic (PAL) devices, electrically programmable logic and memory devices and standard cell-based devices, as well as application specific integrated circuits (ASICs). Some other possibilities for implementing aspects of the systems and methods of monitoring a subject in a premises and corresponding systems and methods include: microcontrollers with memory (such as electronically erasable programmable read only memory (EEPROM)), embedded microprocessors, firmware, software, etc. Furthermore, aspects of the systems and methods described herein may be embodied in microprocessors having software-based circuit emulation, discrete logic (sequential and combinatorial), custom devices, fuzzy (neural) logic, quantum devices, and hybrids of any of the above device types. Of course the underlying device technologies may be provided in a variety of component types, e.g., metal-oxide semiconductor field-effect transistor (MOSFET) technologies like complementary metal-oxide semiconductor (CMOS), bipolar technologies like emitter-coupled logic (ECL), polymer technologies (e.g., silicon-conjugated polymer and metal-conjugated polymer-metal structures), mixed analog and digital, etc. The processing system can include components within a larger computer system.

The methods described herein can be implemented in one or more of software algorithm(s), programs, firmware, hardware, components, circuitry, in any combination. Hardware system includes a standard I/O bus with I/O Ports and mass storage (which can also be a non-volatile Flash Memory) coupled thereto. Bridge couples processor to I/O bus. The hardware system may further include video memory and display device coupled to the video memory. These elements are intended to represent a broad category of computer hardware systems, including but not limited to general-purpose computer systems based on the Pentium processor manufactured by Intel Corporation of Santa Clara, Calif., as well as any other suitable processor.

In addition, what is disclosed is a method of creating a visual acoustic wall display using an acoustic panel 100 which conveys a media such as audio in a visual format, while passively enhancing the quality of the sound. The method includes providing such acoustic panel 100 which includes a translucent insulating material 102 described above, a plurality of lighting elements 108 combined on the underside of the translucent insulating material 102, and the controller 104 combined to the plurality of lighting elements 108 for synchronizing an output of the plurality of lighting elements 108. The method further includes installing the acoustic panel 100, inputting a computer program and/or input data into the controller 104, and controlling the output of the plurality of lighting elements 108 using the computer program and/or input data.

In one embodiment, the method includes controlling the output of the plurality of lighting elements 108 using the controller 104 which includes a chipset 136 comprising at least one chosen from a processor 138, a system memory 140, a network interface 142, a software application 144, and a driver 146. The chipset 136 may be provided with a network interface 142, wherein the method includes the network interface 142 communicating between the processor 138 and the controller 104. The method may include the controller 104 communicating with at least one chosen from a server 128 and a media database 130. A server 128 and media database 130 may provide permanent storage for the computer program and/or input data. For example, the controller 104 may communicate with a media database 130 containing a catalog of audio recordings which may be used as input data. The method may also include the controller 104 communicating with wireless cloud based storage 120.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents.

What is claimed is:

1. An acoustic panel comprising:

a translucent insulating material providing a decorative wall covering;

at least one lighting element combined on an underside of the translucent insulating material, wherein the at least one lighting element includes a plurality of lighting elements arranged in a matrix on a flexible sheet of material, and wherein the translucent insulating material is flexible, and wherein the plurality of lighting elements on the flexible sheet of material are attached on an underside of the translucent insulating material, and wherein the translucent insulating material and the matrix are bound to a backing by an adhesive; and a controller combined to the at least one lighting element for synchronizing an output of the at least one lighting element to at least one characteristic of a media input.

2. The acoustic panel of claim 1, wherein the controller is in communication with a network via at least one chosen from a direct network connection and a wireless network connection.

3. The acoustic panel of claim 1, further comprising a data-in cable and a data-out cable, wherein the data-in cable and the data-out cable penetrate a backing, and wherein at least one chosen from the data-in cable and the data-out cable connect to a second acoustic panel to series connect the acoustic panel and the second acoustic panel.

4. The acoustic panel of claim 1, wherein the output of the at least one lighting element includes a display of light patterns and colors, wherein the display is synchronized to the at least one characteristic of the media input, and wherein the media input is at least one chosen from an audio input, a tune, a song, a visual display, a movie, and a video game.

5. The acoustic panel of claim 4, further comprising:

a recording device in communication with the controller;

wherein the media input is recorded by the recording device and processed by the controller;

wherein the display is synchronized by the controller to correspond to at least one characteristic of the media input.

6. The acoustic panel of claim 1, wherein a plurality of acoustic panels are connected in at least one chosen from serial connection and parallel connection, and wherein the plurality of acoustic panels are arranged on at least one wall to form a largescale synchronized visual display.

7. The acoustic panel of claim 6, wherein each acoustic panel in the plurality of acoustic panels is respectively connected to its own power source.

8. The acoustic panel of claim 1, wherein the controller receives the media input via a device, and wherein the device is at least one chosen from a phone, a virtual assistant, a home monitoring system, a remote control, and a speaker.

9. The acoustic panel of claim 1, wherein the media input is processed by the controller to generate a light pattern for the output of the at least one lighting element.

10. The acoustic panel of claim 1, further comprising mass storage connected to the controller to store data and programming instructions for the at least one lighting element.

11. A method of creating a visual acoustic display comprising:

providing an acoustic panel as a decorative wall covering comprising:

a translucent insulating material;

at least one lighting element combined on an underside of the translucent insulating material, wherein the at least one lighting element includes a plurality of lighting elements arranged in a matrix on a flexible sheet of material, and wherein the translucent insulating material is flexible, and wherein the plurality of lighting elements on the flexible sheet of material are attached on an underside of the translucent insulating material, and wherein the translucent insulating material and the matrix are bound to a backing by an adhesive; and a controller combined to the at least one lighting element;

synchronizing an output of the at least one lighting element to at least one characteristic of a media input; and controlling the output of the at least one lighting element using the at least one characteristic of the media input.

12. The method of claim 11, wherein the media input is at least one chosen from an audio input, a tune, a song, a visual display, a movie, and a video game.

13. The method of claim 11, further comprising connecting a plurality of acoustic panels in at least one chosen from serial connection and parallel connection to form a largescale synchronized visual display.

14. The method of claim 11, further comprising receiving the media input from an internet connection, wherein the internet connection is at least one chosen from a direct internet connection, a wireless internet connection and a device connected to the internet, and wherein the device is at least one chosen from a phone, a virtual assistant, a home monitoring system, a remote control, and a speaker.

15. The method of claim 11, further comprising processing the media input and generating a lighting pattern.

16. The method of claim 11, further comprising connecting mass storage to the controller to store data and programming instructions for the at least one lighting element.

17. The method of claim 11, further comprising controlling the output of the at least one lighting element using the controller, wherein the controller includes a chipset comprising at least one chosen from a processor, a system memory, a network interface, a software application and a driver.

18. The method of claim 17, wherein the network interface provides communication between the processor and the controller.

19. The method of claim 11, wherein the controller is in communication with at least one chosen from a server and a media database to provide permanent storage for the at least one characteristic of the media input.

* * * * *